US009016262B2

(12) United States Patent
Trembath et al.

(10) Patent No.: US 9,016,262 B2
(45) Date of Patent: Apr. 28, 2015

(54) FUEL INJECTOR CONNECTOR DEVICE AND METHOD

(75) Inventors: Bradley Trembath, Chapel Hill, NC (US); Jody L. Stirewalt, Bridgeport, WV (US)

(73) Assignee: Intellectual Property Holdings, LLC, Cleveland, OH (US)

( * ) Notice: Subject to any disclaimer, the term of this patent is extended or adjusted under 35 U.S.C. 154(b) by 673 days.

(21) Appl. No.: 13/303,929

(22) Filed: Nov. 23, 2011

(65) Prior Publication Data

US 2012/0125294 A1 May 24, 2012

Related U.S. Application Data

(60) Provisional application No. 61/416,879, filed on Nov. 24, 2010, provisional application No. 61/476,982, filed on Apr. 19, 2011.

(51) Int. Cl.
*F02M 61/16* (2006.01)
*F02M 43/00* (2006.01)

(52) U.S. Cl.
CPC ..... *F02M 61/16* (2013.01); *F02M 43/00* (2013.01)

(58) Field of Classification Search
CPC ..... F02B 1/04; F02B 2201/062; F02B 43/00; F02B 69/00; F02B 69/04; F02D 19/0694; F02D 19/10; F02M 21/0254; F02M 21/0263; F02M 2200/46
USPC ..... 123/27 GE, 276, 451, 472, 575, 525, 123/25 R
See application file for complete search history.

(56) References Cited

U.S. PATENT DOCUMENTS

| | | | |
|---|---|---|---|
| 3,753,424 | A | 8/1973 | Haidvogel |
| 3,938,611 | A | 2/1976 | Bertolasi |
| 4,090,484 | A | 5/1978 | Itoh et al. |
| 4,305,350 | A | 12/1981 | Brown et al. |
| 4,335,697 | A | 6/1982 | McLean |
| 4,415,507 | A | 11/1983 | Voliva |
| 4,416,229 | A | 11/1983 | Wood |
| 4,463,735 | A | 8/1984 | Stoltman |
| 4,495,930 | A | 1/1985 | Nakajima |

(Continued)

FOREIGN PATENT DOCUMENTS

| | | | |
|---|---|---|---|
| CA | 1211012 | A1 | 9/1986 |
| GB | 1332619 | A | 10/1973 |

(Continued)

*Primary Examiner* — Hai Huynh
*Assistant Examiner* — Gonzalo Laguarda
(74) *Attorney, Agent, or Firm* — Calfee, Halter & Griswold LLP

(57) ABSTRACT

A connector device and method of converting an engine to operate using an alternative fuel is disclosed. In one embodiment, the connector device comprises an outlet portion, a first injector portion, and a second injector portion. The outlet portion is configured to mate with a fuel injector opening of the engine. The outlet portion comprises an outlet channel in fluid communication with a combustion chamber of the engine when the connector device is installed in the fuel injector opening. The first injector portion is configured to receive a first fuel injector and comprises a first injector opening and a first injector channel. The second injector portion is configured to receive a second fuel injector and comprises a second injector opening and a second injector channel. The second injector channel is curved to provide a laminar flow of fuel through the second injector channel.

33 Claims, 8 Drawing Sheets

(56) References Cited

U.S. PATENT DOCUMENTS

| | | | | |
|---|---|---|---|---|
| 4,499,887 | A | 2/1985 | Billingsley et al. | |
| 4,519,371 | A | 5/1985 | Nagase et al. | |
| 4,556,037 | A * | 12/1985 | Wisdom | 123/531 |
| 4,679,538 | A | 7/1987 | Foster | |
| 4,693,227 | A | 9/1987 | Satou | |
| 4,817,568 | A | 4/1989 | Bedford | |
| 4,872,424 | A | 10/1989 | Carnes | |
| 5,024,195 | A | 6/1991 | Pien | |
| 5,035,206 | A | 7/1991 | Welch et al. | |
| 5,097,594 | A | 3/1992 | Daly et al. | |
| 5,115,776 | A | 5/1992 | Ohno et al. | |
| 5,136,990 | A | 8/1992 | Motoyama et al. | |
| 5,163,406 | A | 11/1992 | Daly et al. | |
| 5,174,247 | A | 12/1992 | Tosa et al. | |
| 5,228,423 | A | 7/1993 | Oikawa et al. | |
| 5,237,981 | A | 8/1993 | Polletta et al. | |
| 5,377,645 | A | 1/1995 | Moore | |
| 5,408,978 | A | 4/1995 | Davis | |
| 5,450,832 | A | 9/1995 | Graf | |
| 5,526,797 | A | 6/1996 | Stokes | |
| 5,546,908 | A | 8/1996 | Stokes | |
| 5,549,083 | A | 8/1996 | Fueling | |
| 5,592,924 | A | 1/1997 | Audisio et al. | |
| 5,666,926 | A | 9/1997 | Ferrera et al. | |
| 5,713,336 | A | 2/1998 | King et al. | |
| 5,832,905 | A | 11/1998 | King et al. | |
| 5,881,701 | A | 3/1999 | King et al. | |
| 6,035,837 | A * | 3/2000 | Cohen et al. | 123/575 |
| 6,691,688 | B1 | 2/2004 | Chestnut | |
| 2002/0070295 | A1 * | 6/2002 | Baker et al. | 239/533.3 |
| 2002/0152982 | A1 | 10/2002 | Pietrowski et al. | |
| 2004/0256495 | A1 * | 12/2004 | Baker et al. | 239/533.2 |
| 2009/0107459 | A1 | 4/2009 | Ross, Jr. | |
| 2011/0114070 | A1 | 5/2011 | Liu et al. | |
| 2011/0289916 | A1 | 12/2011 | Dion et al. | |
| 2013/0037622 | A1 * | 2/2013 | Kim et al. | 239/5 |
| 2014/0034023 | A1 * | 2/2014 | Coldren | 123/472 |

FOREIGN PATENT DOCUMENTS

| | | | |
|---|---|---|---|
| JP | 60079153 | A | 5/1985 |
| JP | 62085167 | A | 4/1987 |
| JP | 63080060 | A | 4/1988 |
| WO | 8301486 | | 4/1983 |
| WO | 8303120 | | 9/1983 |

* cited by examiner

FUEL INJECTOR CONNECTOR DEVICE AND METHOD

CROSS REFERENCE TO RELATED APPLICATIONS

This application is a U.S. Non-Provisional Patent Application which claims priority to U.S. Provisional Patent Application No. 61/416,879, filed on Nov. 24, 2010 and titled "Fuel Injector Connector Device and Method," and U.S. Provisional Patent Application No. 61/476,982, filed on Apr. 19, 2011 and titled "Fuel Injector Connector Device and Method," both of which are hereby incorporated by reference in their entirety.

BACKGROUND

Gasoline fuel injectors for an internal combustion engine are generally mounted in the intake manifold or intake port of the engine. The fuel injector injects gasoline into the intake where the gasoline is mixed with air. The resulting mixture is then delivered to one or more combustion chambers of the engine. Gasoline engines may be converted to operate using compressed natural gas (CNG). The intake manifold or intake port of the engine are often removed during this conversion to facilitate placement of a CNG fuel injector. Removal of the intake manifold or intake port increases the time required to complete the conversion, as well as the cost of the conversion.

SUMMARY

The present application discloses a connector device for converting an engine to operate using an alternative fuel, an engine configured to operate using an alternative fuel, and a method of converting an engine to operate using an alternative fuel. The connector device of the present application reduces the time and cost required to convert an engine to operate using an alternative fuel.

In one exemplary embodiment, the connector device comprises an outlet portion, a first injector portion, and a second injector portion. The outlet portion is configured to mate with a fuel injector opening in an internal combustion engine. The outlet portion comprises an outlet channel that is in fluid communication with a combustion chamber of the engine when the connector device is installed in the fuel injector opening. The first injector portion comprises a first injector opening in fluid communication with a first injector channel. The first injector opening is configured to receive a discharge portion of a first fuel injector and the first injector channel is in fluid communication with the outlet channel. The second injector portion comprises a second injector opening in fluid communication with a second injector channel. The second injector opening is configured to receive a discharge portion of a second fuel injector configured to emit a second fuel into the second injector channel. The second injector channel is in fluid communication with the outlet channel. The second injector channel is curved to provide a laminar flow of the second fuel through the second injector channel and into the combustion chamber of the engine when the connector device is installed in the fuel injector opening.

One exemplary method of converting an internal combustion engine to operate using an alternative fuel includes removing a first fuel injector from a fuel injector opening of an internal combustion engine. A connector device of the present application is then installed in the fuel injector opening. The first fuel injector is installed in the first injector opening of the connector device. A second fuel injector is installed in the second injector opening of the connector device.

DESCRIPTION OF EMBODIMENTS

In the following embodiments, the connector device of the present application is described in reference to the conversion of a gasoline engine to operate using an alternative fuel. However, it should be understood, that the connector device of the present application may be used to convert various engines types configured to operate using various types of fuel. For example, the connector device of the present application may be used to convert engines configured to operate using gasoline, diesel, propane, ethanol, or the like.

In the following embodiments, the connector device of the present application may be described as converting a gasoline engine to operate using compressed natural gas (CNG). However, it should be understood, that the connector device of the present application may be used to convert any type of engine to operate using various types of alternative fuel. For example, the connector device of the present application may be used to convert any type of engine to operate using CNG, Liquid Natural Gas (LNG), Liquid Petroleum Gas (LPG), Hydrogen, Hythane, Butane, or other gaseous fuels and mixtures thereof.

Furthermore, it should be understood that the connector device of the present application may be used to convert a single-point or multi-point fuel injection engine. For example, in one embodiment, eight connector devices are coupled to each fuel injector opening or port of an eight cylinder engine to convert the engine to operate using an alternative fuel.

Figure 1:
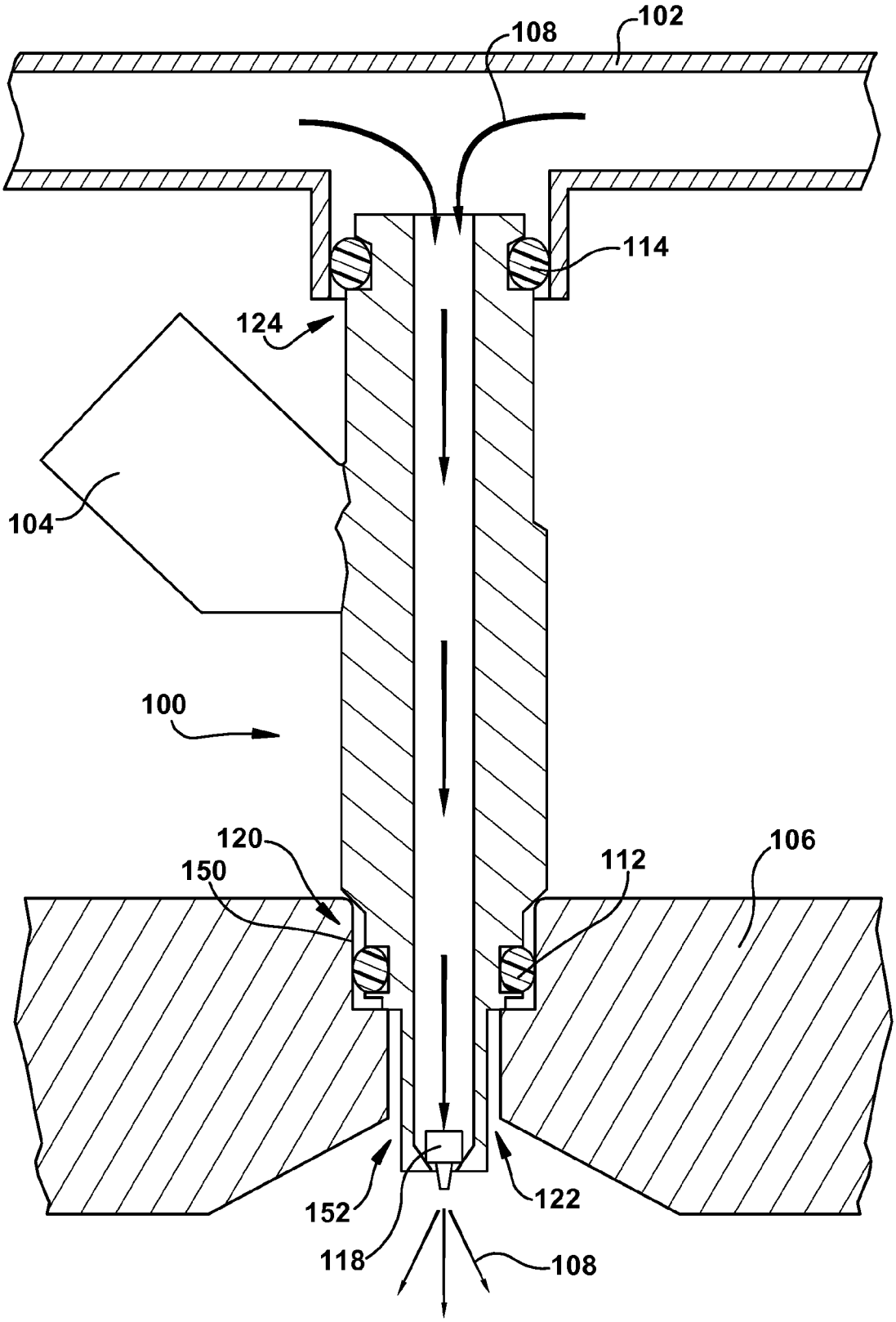
FIG. 1 is a cross sectional view of a fuel injector installed in the intake of an engine.

FIG. 1 illustrates a conventional gasoline fuel injector 100 mounted in an intake 106 of an internal combustion engine, such as, for example, an intake manifold or an intake port of the engine. The intake 106 is in fluid communication with at least one combustion chamber of the engine. As shown in FIG. 1, a first end 120 of the body portion of the gasoline fuel injector 100 is mounted in a fuel injector opening or port 122 in the intake 106 of the engine. The opening 122 includes a recess or counterbore 150 shaped and configured to receive the first end 120 of the body portion of the gasoline fuel injector 100 to mount the injector in the opening. A first o-ring 112 provides a seal between the first end 120 and the opening 122 in the intake 106. A second end 124 of the body portion of the gasoline fuel injector 100 is connected to a gasoline fuel source 102, such as, for example, a fuel rail or fuel line. A second o-ring 114 provides a seal between the second end 124 and the gasoline fuel source 102. The gasoline fuel injector 100 also comprises a valve 118 that is activated electronically to inject gasoline 108 from the discharge portion 152 of the gasoline fuel injector into the intake 106. An electrical connector 104 of the gasoline fuel injector 100 connects the valve 118 to the electrical system of the vehicle.

Figure 2:
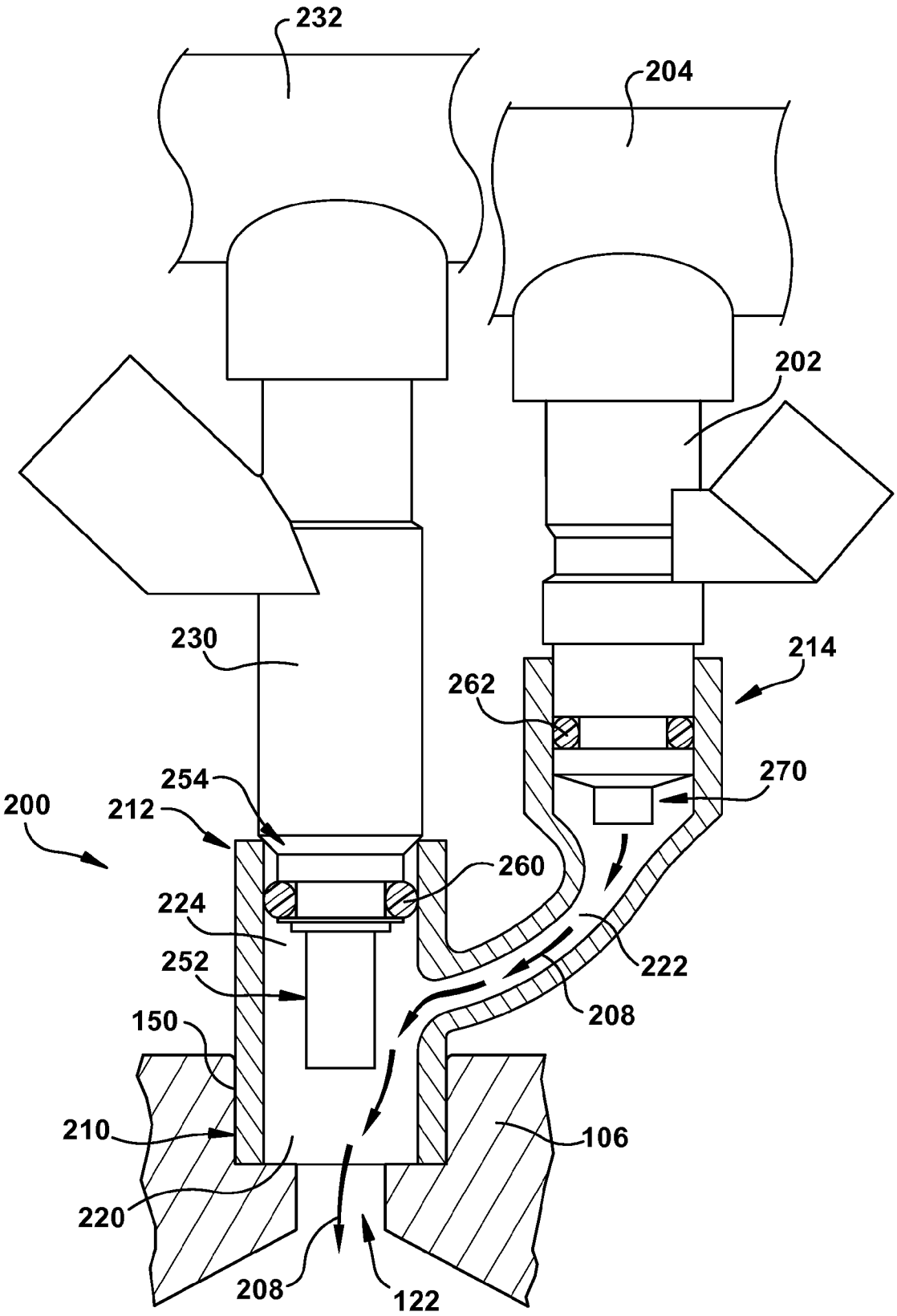
FIG. 2 is a partial cross sectional view of a connector device according to an embodiment of the present application, wherein the connector device is installed in the intake of an engine and a first fuel injector and a second fuel injector are installed in the connector device.

FIG. 2 illustrates a connector device 200 according to an embodiment of the present application. As shown in FIG. 2, the connector device 200 is installed in the opening 122 in the intake 106 of the engine. The connector device 200 comprises a first injector portion 212, a second injector portion 214, and an outlet portion 210. The connector device 200 may be fabricated from a variety of materials capable of supporting each of the fuel injectors, such as, for example, plastic, ferrous, or non-ferrous materials. The connector device 200 may also be a single unitary component or formed from a combination of components.

The outlet portion 210 of the connector device 200 is configured to mate with the opening 122 in the intake 106 of the engine. For example, as illustrated in FIG. 2, the outlet portion 210 of the connector device 200 is shaped and configured to seat within the recess 150 of the opening 122. The outlet portion 210 of the connector device 200 forms a seal with the opening 122. For example, as illustrated in FIG. 2, the outlet portion 210 is shaped and configured to provide an interference fit with the recess 150 of the opening 122 that seals the connector device 200 with the intake 106. However, other methods of sealing the connector device 200 with the intake 106 are envisioned, such as, for example, with an o-ring, sealant, or threaded connection.

The outlet portion 210 of the connector device 200 also comprises an outlet channel 220 formed within the body of device. The outlet channel 220 provides a conduit for the fuel from a first fuel injector 230 and a second fuel injector 202 to exit the outlet of the connector device 200 and enter the intake 106 of the engine, which is in fluid communication with at least one combustion chamber of the engine.

The first injector portion 212 of the connector device 200 comprises a first injector opening and a first injector channel 224 formed within the body of the device. The first injector opening is shaped and configured to receive the first fuel injector 230. As shown, the first fuel injector 230 is installed in the first injector opening and connected to a first fuel source 232. The first injector portion 212 is generally configured to receive a gasoline fuel injector connected to a gasoline fuel source, such as the gasoline fuel injector 100 and the gasoline fuel source 102 illustrated in FIG. 1. However, the first injector portion 212 may be configured to receive any fuel injector, including a CNG fuel injector.

The first injector opening and/or the first injector channel 224 of the first injector portion 212 are configured to form a seal with the first fuel injector 230. For example, as illustrated in FIG. 2, an o-ring 260 of the first fuel injector 230 provides a seal between the first fuel injector and the first injector channel 224. However, other methods of sealing the first fuel injector 230 with the first injector channel 224 are envisioned, such as, for example, with an interference fit, sealant, or threaded connection.

The first injector channel 224 of the first injector portion 212 is in fluid communication with the outlet channel 220 of the outlet portion 210 of the connector device 200. The first injector portion 212 may be configured such that the first fuel injector 230 can be selectively positioned relative to the outlet portion 210 of the connector device 200.

The second injector portion 214 of the connector device 200 comprises a second injector opening and a second injector channel 222 formed within the body of the device. The second injector opening is shaped and configured to receive the second fuel injector 202. As shown, the second fuel injector 202 is installed in the second injector opening and connected to a second fuel source 204. The second injector portion 214 is generally configured to receive a CNG fuel injector connected to a CNG fuel source, such as a CNG fuel rail or a CNG fuel line. However, the second injector portion 214 may be configured to receive any fuel injector, including a gasoline fuel injector (e.g., the gasoline fuel injector 100 illustrated in FIG. 1).

The second injector portion 214 and second injector channel 222 may be shaped and configured in a variety of ways. For example, a longitudinal axis of the second injector portion 214 and/or the second injector channel 222 may be substantially parallel, substantially perpendicular, or angled relative to a longitudinal axis of the first injector portion 212.

The second injector channel 222 may include one or more smooth or gentle curves. As illustrated in FIG. 2, the second injector channel 222 is shaped as a smooth curve and is free of abrupt angles or sharp curves, such as, for example, one or more 90 degree bends. The smooth curve of the second injector channel 222 provides a laminar or non-turbulent flow of fuel 208 (e.g., gaseous fuel, such as CNG) from the second fuel injector 202 through the second injector channel. As discussed below, the laminar or non-turbulent flow of fuel 208 provided by the curved second injector channel 222 results in a consistent fuel charge being delivered to the intake 106 and combustion chamber of the engine.

The second injector opening and/or second injector channel 222 of the second injector portion 214 are configured to form a seal with the second fuel injector 202. For example, as illustrated in FIG. 2, an o-ring 262 of the second fuel injector 202 provides a seal between the second fuel injector and an upper portion of the second injector channel 222. However, other methods of sealing the second fuel injector 202 with the second injector channel 222 are envisioned, such as, for example, with an interference fit, sealant, or threaded connection.

The second injector channel 222 of the second injector portion 214 is in fluid communication with the outlet channel 220 of the outlet portion 210 of the connector device 200. As shown, the connector device 200 is configured such that the second injector channel 222 intersects the outlet channel 220 at a location below the end of a body portion 254 of the first fuel injector 230 to prohibit blockage of the second injector channel. Fuel 208 travels from the second fuel injector 202, through the second injector channel 222, through the outlet channel 220, and exits the outlet of the outlet portion 210 into the intake 106. The intake 106 is in fluid communication with at least one combustion chamber of the engine.

The second injector portion 214 may be configured such that the second fuel injector 202 can be selectively positioned relative to the outlet portion 210 of the connector device 200. Positioning the discharge portion 270 of the second fuel injector 202 in close proximity to the outlet of the connector device 200 results in a sufficient charge of fuel being delivered to the combustion chamber.

FIGS. 3-5B illustrate a connector device 300 according to an embodiment of the present application. As shown, the connector device 300 comprises a first injector portion 312, a second injector portion 314, and an outlet portion 310. The connector device 300 may be made of plastic, ferrous, or non-ferrous material. The connector device 300 may also be substantially rigid such that the device can support a first fuel injector and a second fuel injector.

Figure 5A:
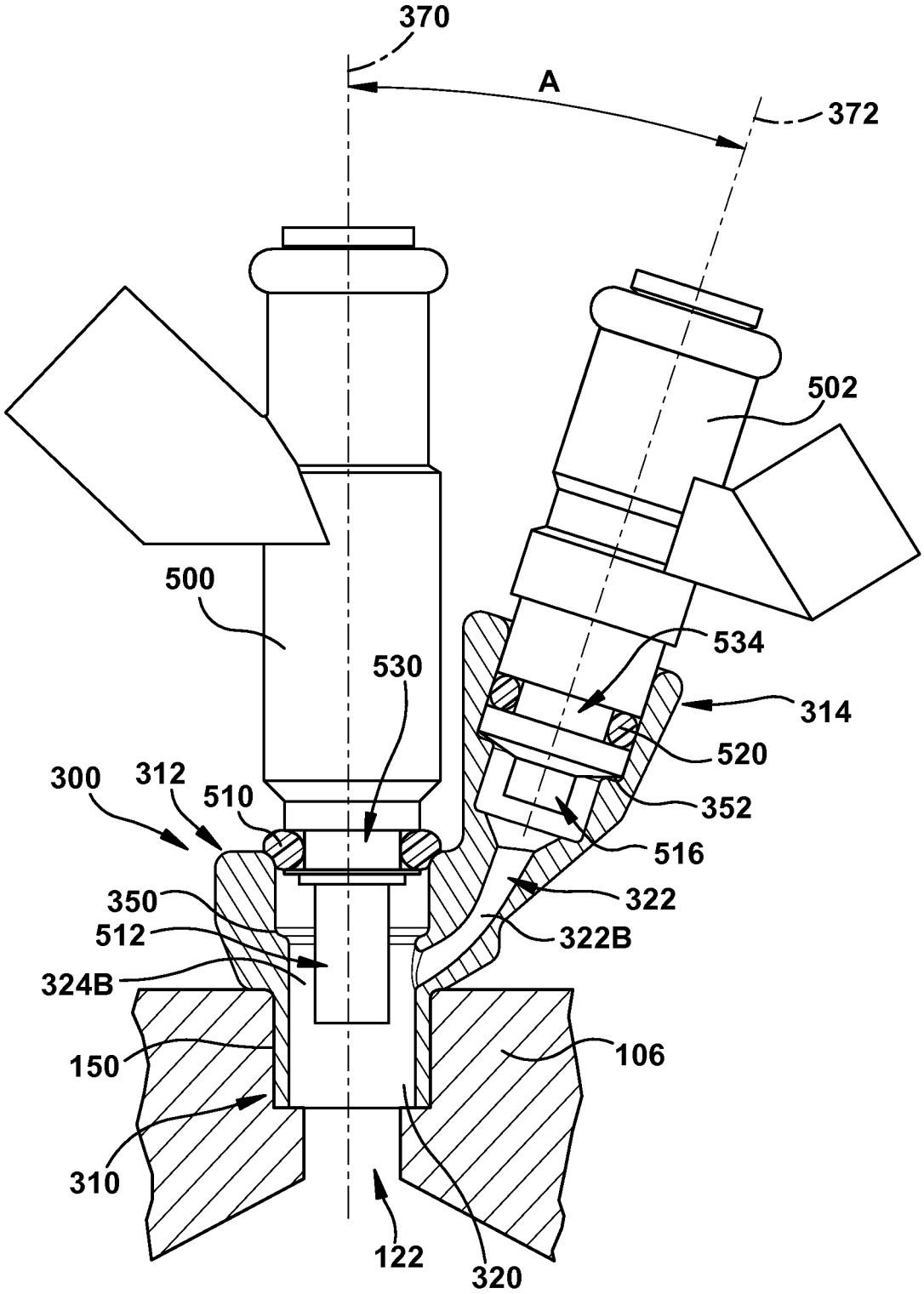
FIG. 5A is a partial cross sectional view of a connector device shown in FIG. 3, wherein the connector device is installed in the intake of an engine and a first gasoline fuel injector and a CNG fuel injector are installed in the connector device.
Figure 5B:
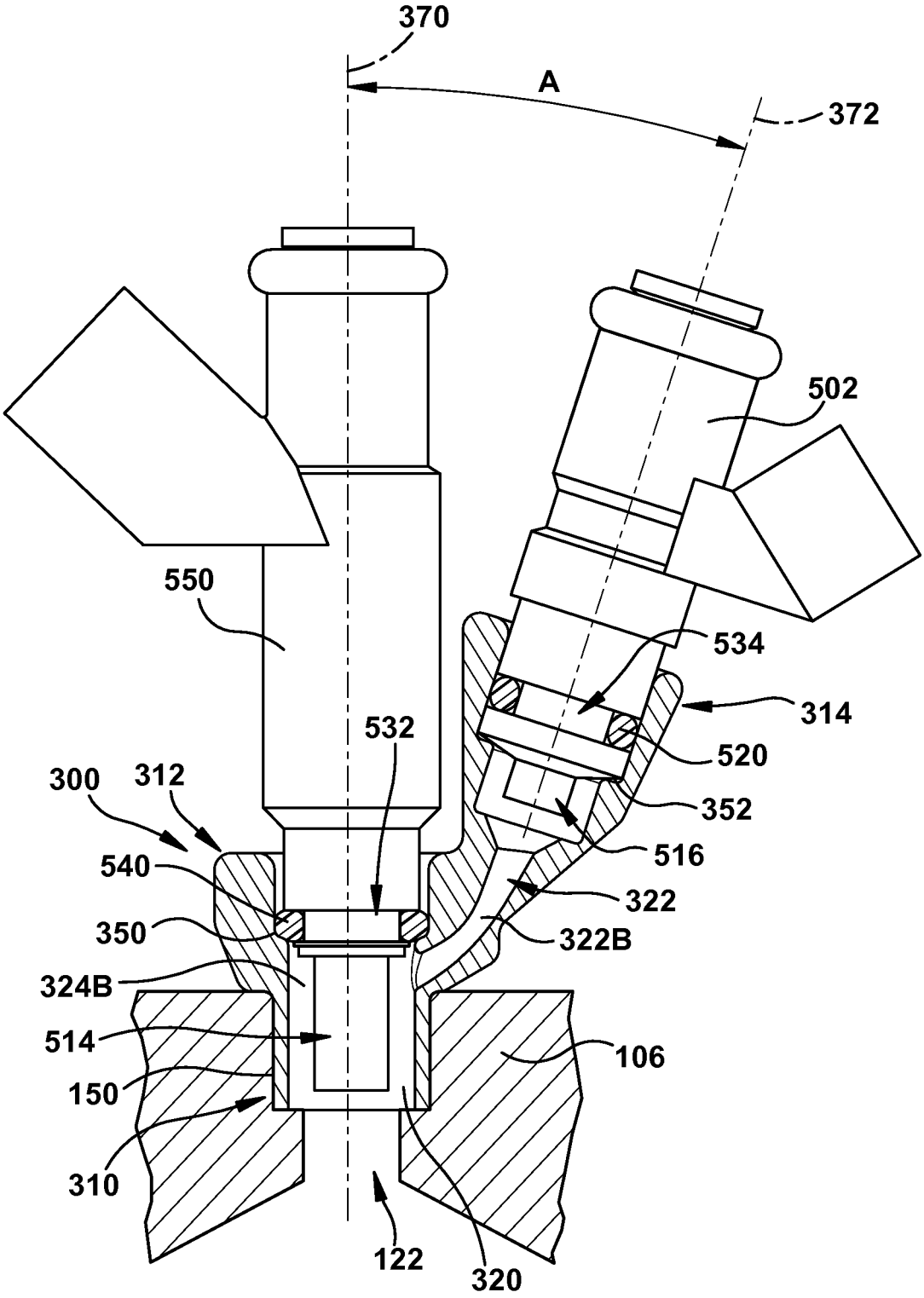
FIG. 5B is a partial cross sectional view of a connector device shown in FIG. 3, wherein the connector device is installed in the intake of an engine and a second gasoline fuel injector and a CNG fuel injector are installed in the connector device.

As illustrated in FIGS. 5A and 5B, the outlet portion 310 of the connector device 300 is configured to mate with the fuel injector opening 122 in the intake 106 of the engine. As shown, the outlet portion 310 is shaped and configured to seat within the recess 150 of the opening 122. Further, the outlet portion 310 forms a seal with the opening 122. The outlet portion 310 includes a cylindrical outer surface 390 configured to provide an interference fit with a corresponding cylindrical inner surface of the recess 150 of the opening 122 in the intake 106. Further, the outlet portion 310 includes a circular bottom face 392 the first injector channel 324 may be shaped and configured to receive a gasoline fuel injector, such as the gasoline fuel injector 100 illustrated in FIG. 1 or the gasoline fuel injectors 500 and 550 shown in FIGS. 5A and 5B, respectively. However, in other embodiments, the first injector portion 312 may be configured to receive any fuel injector, including a CNG fuel injector.

As illustrated in FIG. 5A, a discharge portion 512 of the gasoline fuel injector 500 is inserted into the first injector opening 364 and the first injector channel 324. An o-ring 510 is positioned around a body portion 530 of the gasoline fuel injector 500 and seals the fuel injector with the first injector opening 364 and the first injector channel 324. The o-ring 510 also provides a seat for the gasoline fuel injector 500 and interacts with a lip of the first injector opening 364 to prohibit the fuel injector from being inserted any further into the first injector channel 324. In this position, the gasoline fuel injector 500 is elevated relative to the fuel injector opening 122 in the intake 106 of the engine. The circular face of the counterbore 350 prohibits the o-ring 510 from being sucked into the intake 106 should the o-ring become dislodged or otherwise removed from around the body portion 530 of the gasoline fuel injector 500.

As illustrated in FIG. 5B, the body portion 532 and the discharge portion 514 of the gasoline fuel injector 550 are inserted into the first injector opening 364 and the first injector channel 324. An o-ring 540 is positioned around the body portion 532 of the gasoline fuel injector 550 and seals the fuel injector with the first injector channel 324. The o-ring 540 also provides a seat for the gasoline fuel injector 550 and interacts with the circular face formed by the counterbore 350 to prohibit the fuel injector from being inserted any further into the first injector channel 324. As such, the circular face formed by the counterbore 350 acts as a stop to position the gasoline fuel injector 550 within the first injector channel 324 of the connector device 300. In this position, the gasoline fuel injector 550 is elevated relative to the fuel injector opening 122 in the intake 106 of the engine. Other methods of sealing the gasoline fuel injectors 500 and 550 with the channel 320 are circular in shape and the outlet channel has a radius $O_R$ between about ⅛ inch and ½ inch. In one embodiment, the radius $O_R$ of the outlet channel 320 is about ¼ inch. However, other shapes or configurations capable of providing a sufficient flow of fuel to the combustion chamber may be used, e.g., oval or rectangular.

Figure 3:
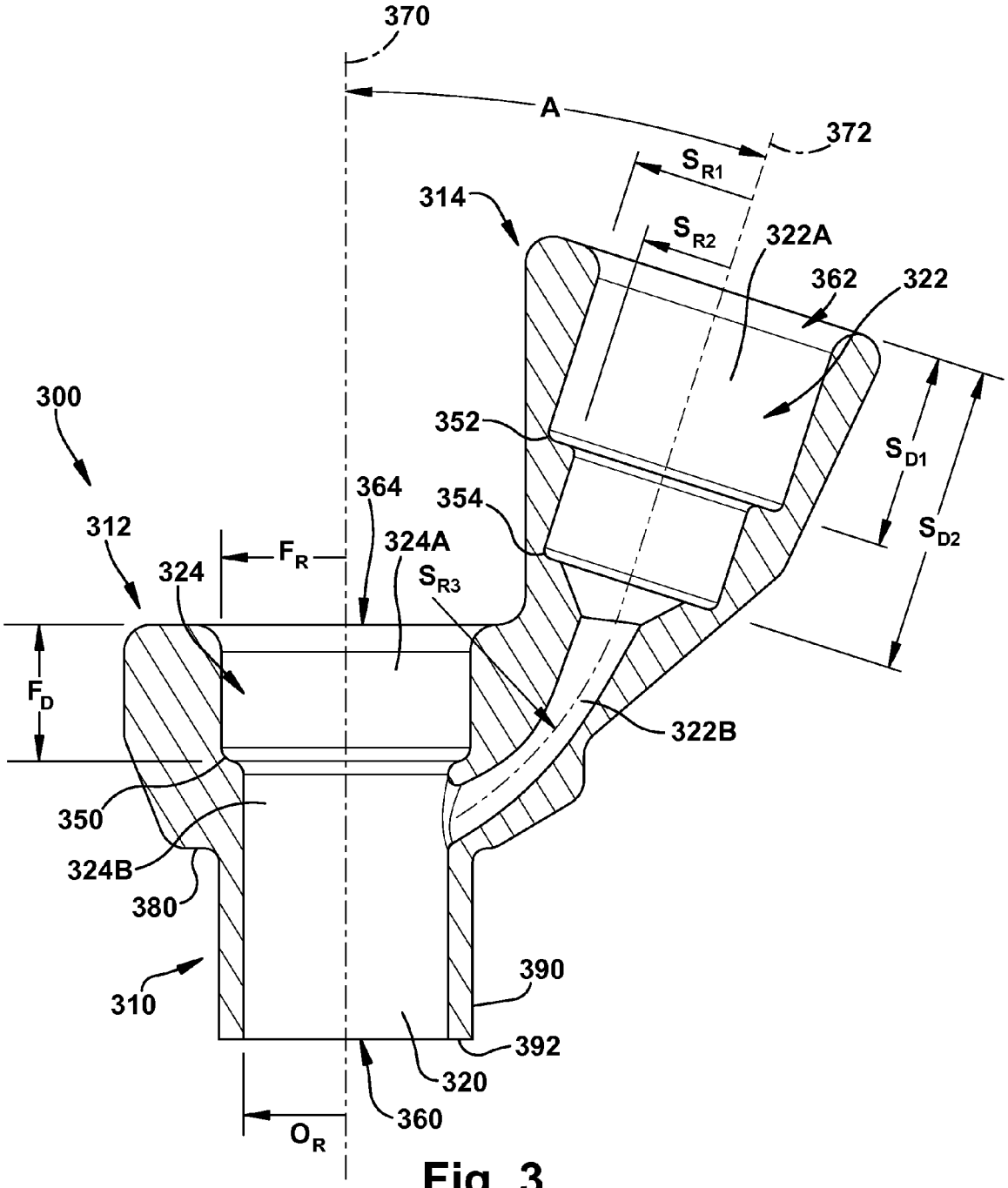
FIG. 3 is a left side cross sectional view of a connector device according to an embodiment of the present application.

As illustrated in FIGS. 3 and 5A-5B, when the connector device 300 is installed in the opening 122 in the intake 106, the longitudinal axis 370 of the outlet 360 and the outlet channel 320 is substantially parallel to and aligned with the longitudinal axis 370 of the opening in the intake. Furthermore, the longitudinal axis 370 of a gasoline fuel injector 500 and 550 (FIGS. 5A and 5B, respectively) is substantially parallel to and aligned with the longitudinal axis 370 of the opening 122 in the intake 106.

As illustrated in FIG. 3, the first injector portion 312 of the connector device 300 includes a first injector opening 364 and a first injector channel 324 formed within the body of the device. The longitudinal axis 370 of the first injector opening 364 and the first injector channel 324 are substantially parallel to and aligned with the longitudinal axis 370 of the outlet 360 and the outlet channel 320.

Figure 4A:
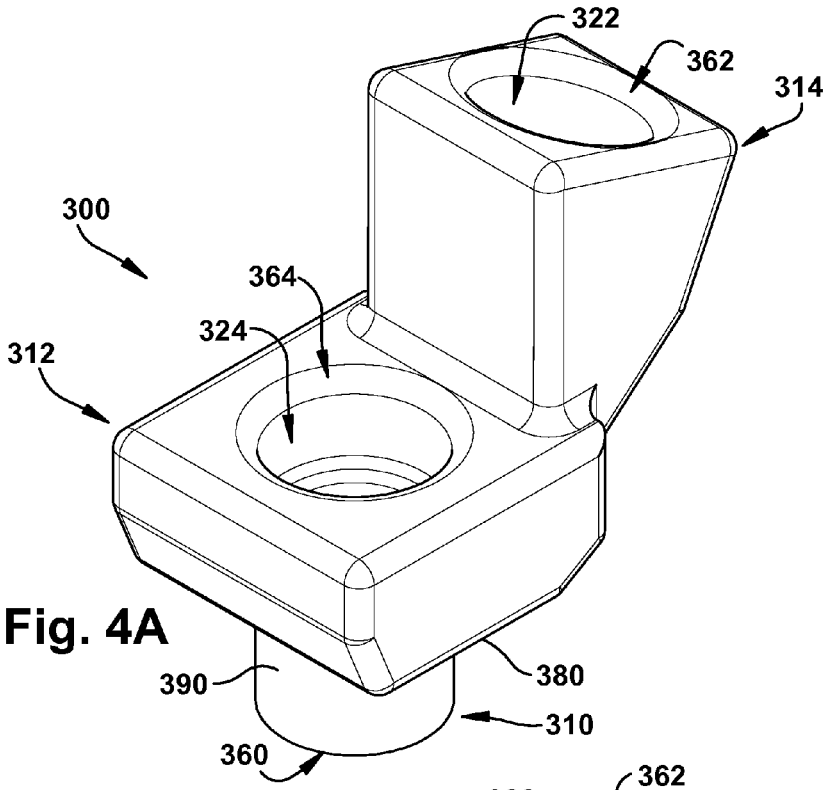
FIG. 4A is front top perspective view of the connector device shown in FIG. 3.
Figure 4B:
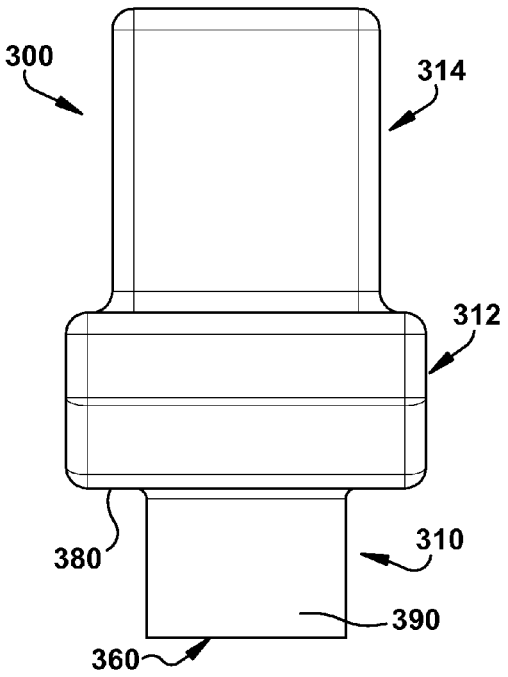
FIG. 4B is a front view of the connector device shown in FIG. 3.
Figure 4C:
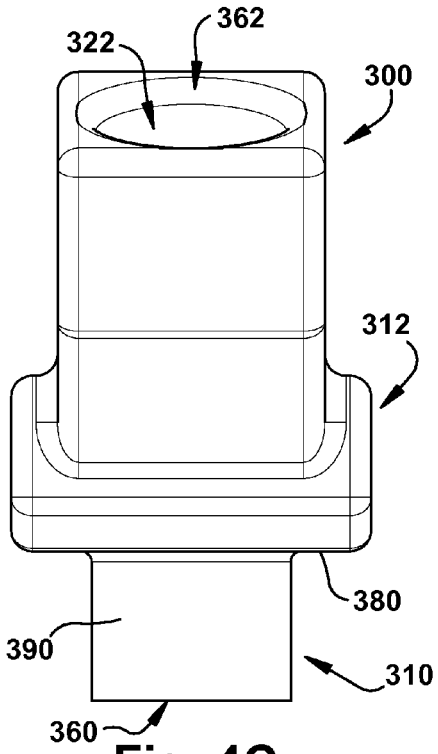
FIG. 4C is a rear view of the connector device shown in FIG. 3.
Figure 4D:
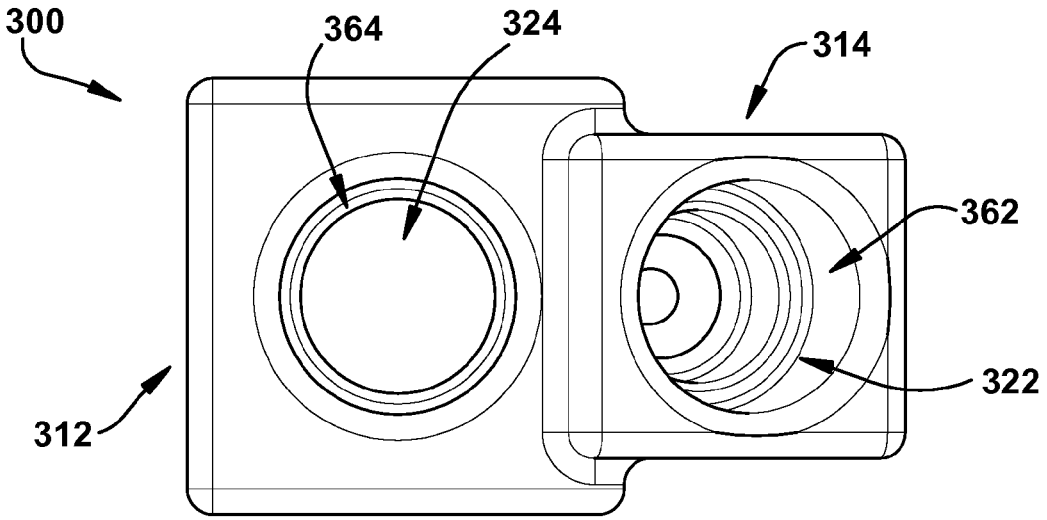
FIG. 4D is top view of the connector device shown in FIG. 3.
Figure 4E:
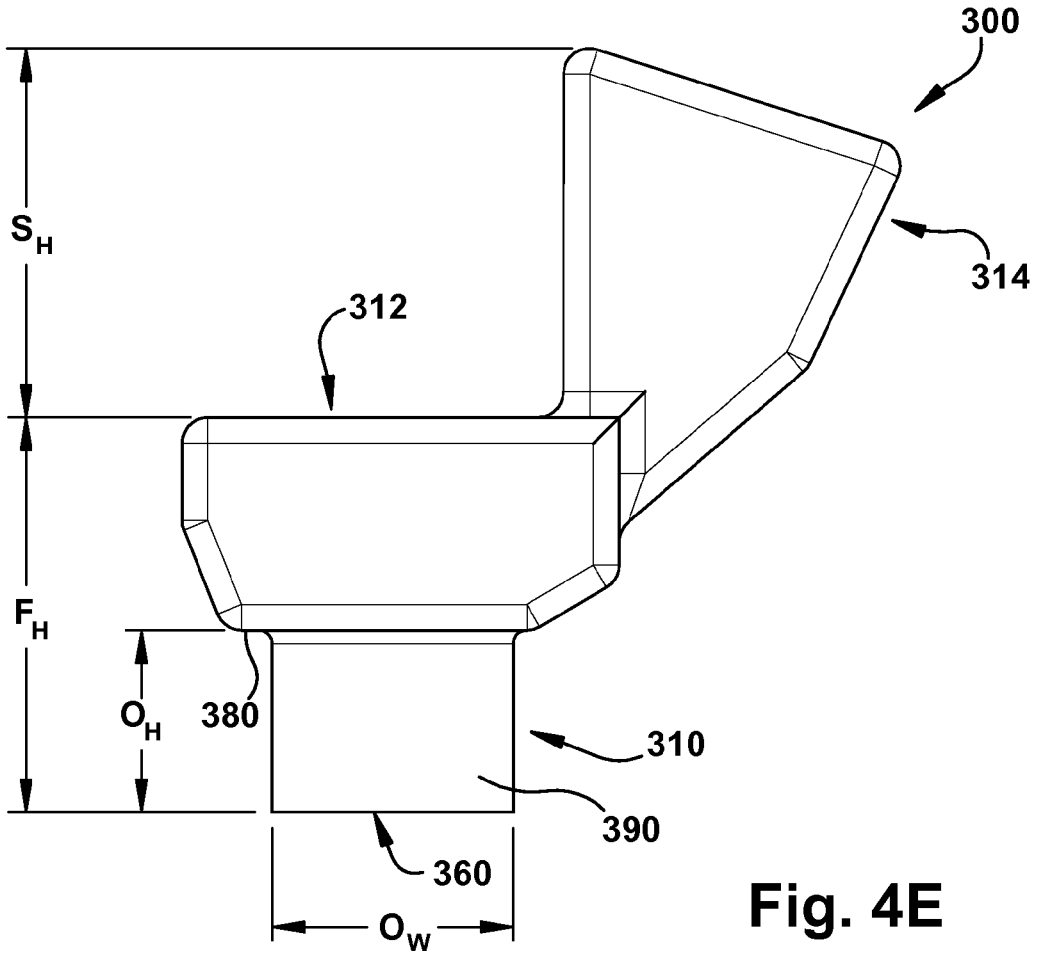
FIG. 4E is a left side view of the connector device shown in FIG. 3.
Figure 4F:
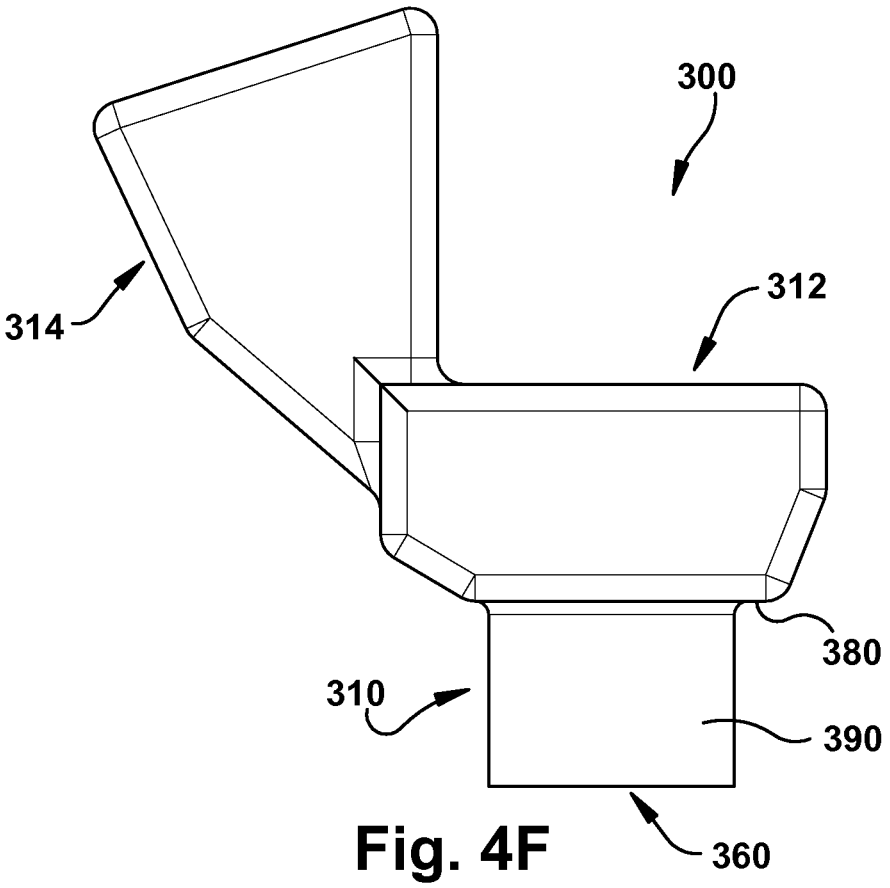
FIG. 4F is a right side view of the connector device shown in FIG. 3.
Figure 4G:
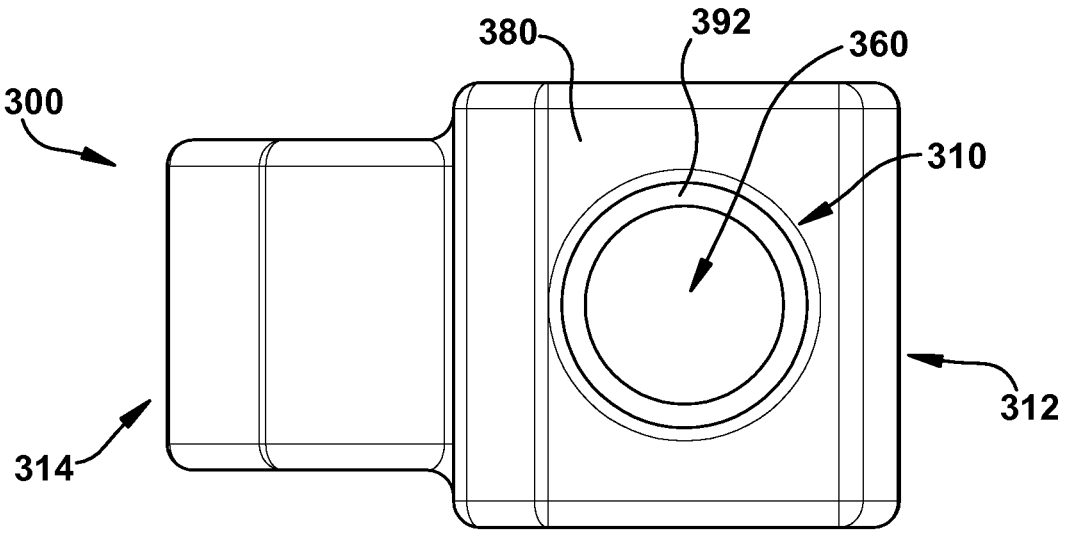
FIG. 4G is a bottom view of the connector device shown in FIG. 3.

As illustrated in FIG. 4E, the first injector portion 312 extends up from the circular bottom face 392 of the outlet portion 310 a distance $F_H$ between about ½ inch and 2 inches. In one embodiment, the distance $F_H$ is about ¾ inch. Further, as illustrated in FIG. 3, the first injector opening 364 and a first portion 324A of the first injector channel 324 have a radius $F_R$ between about ⅛ inch and ½ inch. In one embodiment, the radius $F_R$ is about ¼ inch. The first injector channel 324 also comprises a counterbore 350 having a depth $F_D$ between about ⅛ inch and ½ inch. In one embodiment, the depth $F_D$ is about ¼ inch.

The first injector portion 312 may be configured to receive the first fuel injector. For example, the first injector opening 364 and a first portion 324A of shaped and configured to mate with a circular face of the recess 150 of the opening 122. However, it should be understood that the connector devices of the present application may also be installed in a fuel injector opening having no recess or counterbore. For example, in such embodiments, a bottom surface 380 of the connector device 300 may act as a stop to facilitate installation of the connector device in the fuel injector opening without a recessed or counterbored portion.

As illustrated in FIG. 4E, the outer diameter $O_W$ of the outlet portion 310 is between about ¼ inch and ¾ inch. In one embodiment, the outer diameter $O_W$ is about ½ inch. Other shapes and configurations of the outlet portion are envisioned to seal the device with a variety of openings in the intake manifold or intake port of an engine. Also, other methods of sealing the device with the intake manifold or intake port are envisioned, such as, for example, with an o-ring, sealant, threaded connection, and/or sealing material.

As stated above, the bottom surface 380 of the first injector portion 312 may act as a stop to facilitate insertion of the connector device 300 into a fuel injector opening in the intake manifold or intake port of an engine. For example, the outlet portion 310 of the connector device 300 may be inserted into the fuel injector opening a distance $O_H$ (FIG. 4E) until the bottom surface 380 of the first injector portion 312 contacts the outer surface of the intake manifold or intake port. The distance $O_H$ between the circular bottom face 392 of the outlet portion 310 and the bottom surface 380 of the first injector portion 312 is between about ¼ inch and 1 inch. In one embodiment, the distance $O_H$ is about ½ inch.

The outlet portion 310 of the connector device 300 comprises an outlet 360 and an outlet channel 320 formed within the body of device. The outlet channel 320 provides a conduit for the fuel from the first and second fuel injectors to exit the outlet 360 of the connector device 300 and enter the intake manifold or intake port of the engine. As illustrated in FIG. 3, the outlet 360 and the outlet first injector channel 324 are envisioned, such as, for example, with an interference fit, sealant, or threaded connection.

As illustrated in FIGS. 5A and 5B, the first injector portion 312 of the connector device 300 is configured to position the discharge portion 512 and 514 of the gasoline fuel injector 500 and 550 below the counterbore 350. As such, the fuel from the gasoline fuel injector 500 and 550 is emitted into the second portion 324B of the first injector channel 324 and/or the outlet channel 320 of the outlet portion 310. The second portion 324B of the first injector channel 324 is in fluid communication with the outlet channel 320 of the outlet portion 310. Furthermore, as shown in FIG. 3, the second portion 324B of the first injector channel 324 has the same radius, $O_R$, as the outlet channel 320. In addition, as shown in FIGS. 5A and 5B, the first injector opening 364 and/or the counterbore 350 of the connector device 300 prohibit the body portion 530 and 532 of the gasoline fuel injector 500 and 550 from blocking the second injector channel 322 and/or the fuel emitted from the second fuel injector, which is shown in FIGS. 5A and 5B as CNG fuel injector 502.

The second injector portion 314 of the connector device 300 comprises a second injector opening 362 and a second injector channel 322 formed within the body of the device. As illustrated in FIGS. 5A and 5B, the second injector portion 314 is configured to receive the CNG fuel injector 502. However, in other embodiments, the second injector portion 314 may be configured to receive any fuel injector, including a gasoline fuel injector (e.g., the gasoline fuel injector 100 illustrated in FIG. 1).

The connector device 300 is configured to facilitate installation of the second fuel injector for injecting a second fuel into the engine. For example, the second injector portion 314 of the connector device 300 extends upward and away from the first injector portion 312 and the first fuel injector. In this configuration, the second injector opening 362 of the second injector portion 314 is accessible for installation of the second fuel injector. As illustrated in FIG. 4E, the second injector portion 314 extends up from the first injector portion 312 a distance $S_H$ between about ½ inch and 2 inches. In one embodiment, the distance $S_H$ is about ¾ inch.

The second injector portion 314 also extends away from the first injector portion 312. As illustrated in FIG. 3, the longitudinal axis 372 of the second injector opening 362 and a first portion 322A of the second injector channel 322 extends at an angle A relative to the longitudinal axis 370 of the first injector opening 364, first injector channel 324, outlet 360 and outlet channel 320 of the connector device 300. The angle A may be between about 5 degrees and 45 degrees. In one embodiment, the angle A is about 20 degrees. Further, as illustrated in FIGS. 5A and 5B, when the connector device 300 is installed in the opening 122 in the intake 106 of the engine, the longitudinal axis 372 of the second injector opening 362 and the first portion 322A of the second injector channel 322 extends at the angle A relative to the longitudinal axis 370 of the opening in the intake. Still further, the longitudinal axis 372 of the CNG fuel injector 502 (or any other second fuel injector) installed in the second injector opening 362 extends at the angle A relative to the longitudinal axis 370 of the gasoline fuel injector 500 and 550 shown in FIGS. 5A and 5B, respectively.

The second injector opening 362 and the first portion 322A of the second injector channel 322 are shaped and configured to receive the second fuel injector. As illustrated in FIG. 3, the first portion 322A of the second injector channel 322 comprises a first counterbore 352 and a second counterbore 354. The first counterbore 352 has a depth $S_{D1}$ between about ¼ inch and ¾ inch. In one embodiment, the depth $S_{D1}$ is about ½ inch. The second counterbore 354 has a depth $S_{D2}$ between about ⅜ inch and 1 inch. In one embodiment, the depth $S_{D2}$ is about ¾ inch. The second injector opening 362 and the first counterbored portion of the second injector channel 322 have a radius $S_{R1}$ between about ⅛ inch and ½ inch. In one embodiment, the radius $S_{R1}$ is about ¼ inch. The second counterbored portion of the second injector channel 322 has a radius $S_{R2}$ between about 1/16 inch and ½ inch. In one embodiment, the radius $S_{R2}$ is about ⅛ inch.

The second injector opening 362 and/or the circular face formed by the first counterbore 352 or the second counterbore 354 act as a stop to position the second fuel injector within the second injector channel 322 of the connector device 300. For example, as illustrated in FIGS. 5A and 5B, the body portion 534 and the discharge portion 516 of the CNG fuel injector 502 are inserted into the second injector opening 362 and the second injector channel 322. An o-ring 520 is positioned around the body portion 534 of the CNG fuel injector 502 and seals the fuel injector with the second injector channel 322. The body portion 534 of the CNG fuel injector 502 also interacts with the circular face formed by the first counterbore 352 to seat the fuel injector within the second injector channel 322 and prohibit the fuel injector from being inserted any further into the second injector channel. As such, the circular face formed by the first counterbore 352 acts as a stop to position the CNG fuel injector 502 within the second injector channel 322 of the connector device 300. Other methods of sealing the second fuel injector with the second injector channel 322 are envisioned, such as, for example, with an interference fit, sealant, or threaded connection.

As illustrated in FIGS. 5A and 5B, the second injector portion 314 is configured to position the discharge portion 516 of the CNG fuel injector 502 (i.e., the portion of the CNG fuel injector emitting the CNG) in close proximity to the outlet 360 of the connector device 300 without interfering with the positioning of the gasoline fuel injector 500 and 550. Positioning the emitting end of the CNG fuel injector 502 in close proximity to the outlet 360 of the connector device 300 results in a sufficient charge of the CNG fuel being delivered to the combustion chamber.

The fuel from the second fuel injector is emitted into the second portion 322B of the second injector channel 322. The second portion 322B of the second injector channel 322 is in fluid communication with the outlet channel 320 of the outlet portion 310. Further, as discussed above, the connector device 300 is configured such that the intersection of the second injector channel 322 and the outlet channel 320 is located relative to the first fuel injector such that the second injector channel is not blocked as to prohibit fuel from the second fuel injector from entering the outlet channel.

The second portion 322B of the second injector channel 322 is configured to provide a laminar or non-turbulent flow of fuel from the second fuel injector to the outlet channel 320 of the connector device 300. For example, as illustrated in FIGS. 3 and 5A-5B, the curved second portion 322B of the second injector channel 322 is configured such that the flow of fuel from the second injector (e.g., the CNG emitted from the CNG fuel injector 502) through the second portion 322B has a Reynolds Number less than 10,000. As such, the flow of fuel is considered to be of a laminar or non-turbulent type. In one embodiment, the flow of CNG emitted from the CNG fuel injector 502 through the curved second portion 322B has a Reynolds Number between about 1900 and 7000. In another embodiment, the flow of CNG emitted from the CNG injector 502 through the curved second portion 322B has a Reynolds Number greater than 2100 but less than 10,000.

Using the standard Reynolds Number Formula, a straight tube having the same or similar interior diameter as the curved second portion 322B will produce a flow of fuel having a Reynolds Number greater than 2,500, or about 2,573. However, the threshold for laminar or non-turbulent flow of a straight tube with the same or similar interior diameter as the curved second portion 322B is a Reynolds Number less than 2100. As such, a straight tube having the same or similar interior diameter as the curved second portion 322B will not produce laminar flow and instead create turbulence. However, the curve in the second portion 322B increases the threshold for laminar flow due to the Dean Effect. The curve in the second portion 322B increases the threshold for laminar flow to a Reynolds Number greater than 2100 but less than 10,000. Therefore, the curve in the second portion 322B causes laminar flow to be provided.

The laminar flow of fuel provided by the second portion 322B of the second injector channel 322 is important for proper functioning of the engine. In this regard, the laminar flow of fuel results in a more consistent fuel charge delivered to the intake manifold or intake port of the engine. As such, accurate metering of the fuel charge from the second fuel injector is possible in a short amount of time, e.g., approximately 6 milliseconds or the firing time of the second fuel injector.

Alternatively, abrupt angles, sharp turns, and/or rough surfaces in the flow channel leading from the second injector may result in a more turbulent flow of fuel. As illustrated in FIGS. 3 and 5A-5B, no portion of the second injector channel 322 causes the flow of the second fuel from the second injector, such as the CNG emitted from the CNG injector 502, to abruptly change direction. The second injector channel 322 is free of abrupt angles and sharp turns, such as, for example, a 90 degree bend in the channel, that would force the fuel from the second injector to abruptly change direction. Further, as illustrated in FIGS. 3 and 5A-5B, no portion of the second injector channel 322 at least partially blocks the outlet of the second fuel injector or forces the fuel emitted from the second fuel injector to abruptly change direction. Still further, the surface of the second injector channel 322 is smooth and does not comprise a rough surface that would result in a more turbulent flow of fuel.

A turbulent flow of fuel results in a less consistent fuel charge delivered to the combustion chamber of the engine. An inconsistent fuel charge changes the Stoichiometric mixture of air and fuel and causes the engine to run lean and/or rich. If the engine runs lean and/or rich, emission level requirements at the tailpipe may not be met and/or may cause engine failure. As such, the smooth, laminar flow of fuel provided by the curved second portion 322B of the second injector channel 322 permits the connector device 300 to meet emission level requirements, such as those outlined in U.S. Environmental Protection Agency standard 40 CFR 86.1801-01 through 40 CFR 86.1815-02.

As illustrated in FIGS. 3 and 5A-5B, the second portion 322B of the second injector channel 322 has a smooth surface and a gentle curve resulting in a laminar flow of fuel from the second fuel injector, such as the CNG from the CNG injector 502, to the outlet channel 320 of the connector device 300. As illustrated in FIG. 3, the radius of the curvature $S_{R3}$ for the second portion 322B is preferably between about 2 mm and 50 mm, or more preferably about 25 mm. The interior diameter of the second portion 322B is preferably between about 1.5 mm and 3 mm, or more preferably about 2 mm. Further, when the second fuel injector is installed in the connector device 300, no portions of the second portion 3228 block the outlet of the second fuel injector or force the fuel from the second fuel injector to abruptly change direction. Instead, the smooth, gentle curve of the second portion 322B directs the fuel into the outlet channel 320 of the connector device 300.

The connector device of the present application facilitates the conversion of a gasoline engine to operate using CNG. The connector device may be described as a "plug and play" system. In other words, the connector device permits the gasoline engine to be converted to operate using CNG without removal of the intake manifold or intake port to install the CNG fuel injector. Thus, the time required to complete the conversion, as well as the cost of the conversion, is reduced by use of the connector device.

One exemplary method of installing a connector device of the present application is described below. The exemplary method is described with reference to connector device 300; however, the method may be applicable to any connector device of the present application. A method of installing connector device 300 includes removing a gasoline fuel injector (e.g., the gasoline fuel injector 100 illustrated in FIG. 1) from the opening 122 in the intake 106 of the engine and installing the connector device 300 in the opening. The connector device 300 may be installed by inserting the outlet portion 310 of the device into the opening 122 until the bottom surface 380 of the first injector portion 312 contacts the outer surface of the intake 106.

The gasoline fuel injector is inserted into the first injector opening 364 of the first injector portion 312. The gasoline fuel injector is selectively positioned within the first injector channel 324. As described above, the first injector opening 364 and/or the counterbore 350 may be used to facilitate positioning of the gasoline fuel injector within the first injector channel 324. The fuel source and/or electrical connection for the gasoline fuel injector may or may not be disconnected from the fuel injector to permit removal of the fuel injector from the intake manifold or intake port and/or installation of the fuel injector in the connector device 300.

A CNG fuel injector is inserted into the second injector opening 362 of the second injector portion 314. The CNG fuel injector is selectively positioned within the second injector channel 322. As described above, the second injector opening 362, the first counterbore 352, and/or the second counterbore 354 may be used to facilitate positioning of the CNG fuel injector within the second injector channel 322. The fuel source and electrical components may be connected to the CNG fuel injector. The steps above may be repeated for each fuel injector opening of the internal combustion engine to convert the engine to operate using CNG.

It should be understood that the method described above may be used to convert any type of engine to operate using various types of alternative fuel. For example, the method may be used to convert engines configured to operate using gasoline, diesel, propane, ethanol, or the like to operate using CNG, Liquid Natural Gas (LNG), Liquid Petroleum Gas (LPG), Hydrogen, Hythane, Butane, or other gaseous fuels and mixtures thereof. Further, it should be understood that the fuel injectors used may be inserted to either or both of the injector openings. For example, a conventional fuel injector (e.g., gasoline) may be inserted into the second injector opening 362 and an alternative fuel injector (e.g., the CNG injector) may be inserted into the first injector opening 364.

As described herein, when one or more components are described as being connected, joined, affixed, coupled, attached, or otherwise interconnected, such interconnection may be direct as between the components or may be in direct such as through the use of one or more intermediary components. Also as described herein, reference to a "member," "component," or "portion" shall not be limited to a single structural member, component, or element but can include an assembly of components, members or elements.

While the present invention, has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasably or removably connected or attached together, any type of releasable connection may be suitable including for example, locking connections, fastened connections, tongue and groove connections, etc. Still further, component geometries, shapes, and dimensions can be modified without changing the overall role or function of the components. The connector device of the present application may be configured with more or less injector portions. For example, the connector device of the present application may include a third injector portion shaped and configured to receive a third fuel injector. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. A connector device for converting an internal combustion engine to operate using a second fuel, the connector device comprising:

an outlet portion configured to mate with a fuel injector opening in the internal combustion engine, wherein the outlet portion is shaped and configured to provide an interference fit with the fuel injector opening, the outlet portion comprising an outlet channel in fluid communication with a combustion chamber of the engine when the connector device is installed in the fuel injector opening;

a first injector portion comprising a first injector opening in fluid communication with a first injector channel, wherein the first injector opening is configured to receive a discharge portion of a first fuel injector for emitting a first fuel and the first injector channel is in fluid communication with the outlet channel; and a second injector portion comprising a second injector opening in fluid communication with a second injector channel, wherein the second injector opening is configured to receive a discharge portion of a second fuel injector configured to emit a second fuel into the second injector channel, wherein the second fuel is in a gaseous state upon emission from the second fuel injector into the second injector channel, and wherein the second injector channel is in fluid communication with the outlet channel; and wherein the second injector channel is curved to provide a laminar flow of the second fuel through the second injector channel and into the combustion chamber of the engine when the connector device is installed in the fuel injector opening.

2. The connector device of claim 1, wherein the second fuel injector is a compressed natural gas injector configured to emit compressed natural gas fuel into the second injector channel, and wherein the flow of the compressed natural gas fuel through the second injector channel has a Reynolds Number between about 1900 and 7000.

3. The connector device of claim 2, wherein the flow of the compressed natural gas fuel through the second injector channel has a Reynolds Number greater than 2100 but less than 10,000.

4. The connector device of claim 1, wherein no portion of the second injector channel at least partially blocks an outlet of the second fuel injector.

5. The connector device of claim 1, wherein no portion of the second injector channel causes the second fuel emitted from the second fuel injector to abruptly change direction.

6. The connector device of claim 5, wherein the second injector channel is free of abrupt angles and sharp turns such that the second fuel emitted from the second fuel injector does not abruptly change direction.

7. The connector device of claim 1, wherein the radius of curvature of the second injector channel is between about 2 mm and 50 mm.

8. The connector device of claim 7, wherein the radius of curvature of the second injector channel is about 25 mm.

9. The connector device of claim 1, wherein the diameter of the second injector channel is between about 1.5 mm and 3 mm.

10. The connector device of claim 9, wherein the diameter of the second injector channel is about 2 mm.

11. The connector device of claim 1, wherein the second injector portion extends upward and away from the first injector portion.

12. The connector device of claim 11, wherein the second injector portion extends vertically upward from the first injector portion a distance between about % inch and 2 inches.

13. The connector device of claim 1, wherein a longitudinal axis of the second injector opening extends at an angle between about 5 degrees and 45 degrees relative to a longitudinal axis of the first injector opening.

14. The connector device of claim 13, wherein the angle between the longitudinal axis of the second injector opening and the longitudinal axis of the first injector opening is about 20 degrees.

15. The connector device of claim 1, wherein the first fuel injector is a gasoline injector and the second fuel injector is a compressed natural gas injector.

16. The connector device of claim 1, wherein the connector device is made from a single piece of substantially rigid plastic.

17. The connector device of claim 1, wherein a first o-ring of the first fuel injector provides a seal between the first fuel injector and the first injector channel, and wherein a second o-ring of the second fuel injector provides a seal between the second fuel injector and the second injector channel.

18. The connector device of claim 1, wherein the second injector channel intersects the outlet channel at a location below an end of a body portion of the first fuel injector to prohibit blockage of the second injector channel.

19. The connector device of claim 1, wherein a longitudinal axis of the outlet channel is substantially parallel to and aligned with a longitudinal axis of the fuel injector opening, and wherein a longitudinal axis of the first injector opening and the first injector channel is substantially parallel to and aligned with the longitudinal axis of the outlet channel.

20. The connector device of claim 1, wherein the first fuel injector is elevated relative to the fuel injector opening in the internal combustion engine when the connector device is installed in the fuel injector opening.

21. The connector device of claim 1, wherein the second fuel is an alternative fuel.

22. A connector device for converting an internal combustion engine to operate using a second fuel, the connector device comprising:

an outlet portion configured to mate with a fuel injector opening in the internal combustion engine, the outlet portion comprising an outlet channel in fluid communication with a combustion chamber of the engine when the connector device is installed in the fuel injector opening, wherein the outlet portion is shaped and configured to provide an interference fit with the fuel injector opening; and wherein a longitudinal axis of the outlet channel is substantially parallel to and aligned with a longitudinal axis of the fuel injector opening;

a first injector portion comprising a first injector opening in fluid communication with a first injector channel, wherein the first injector opening is configured to receive a discharge portion of a first fuel injector for emitting a first fuel and the first injector channel is in fluid communication with the outlet channel, and wherein a longitudinal axis of the first injector opening and the first injector channel is substantially parallel to and aligned with the longitudinal axis of the outlet channel; and a second injector portion comprising a second injector opening in fluid communication with a second injector channel, wherein the second injector opening is configured to receive a discharge portion of a second fuel injector configured to emit a second fuel into the second injector channel, wherein the second fuel is a gas upon emission from the second fuel injector into the second injector channel, and wherein the second injector channel is in fluid communication with the outlet channel, and wherein the second injector portion extends upward and away from the first injector portion; and wherein a longitudinal axis of the second injector opening extends at an angle between about 5 degrees and 45 degrees relative to the longitudinal axis of the first injector opening; and wherein the second injector channel is curved and comprises a radius of curvature between about 2 mm and 50 mm and a diameter between about 1.5 mm and 3 mm, and wherein the second injector channel provides a laminar flow of the second fuel through the second injector channel and into the combustion chamber of the engine when the connector device is installed in the fuel injector opening.

23. The connector device of claim 22, wherein the second injector channel intersects the outlet channel at a location below an end of a body portion of the first fuel injector to prohibit blockage of the second injector channel.

24. The connector device of claim 22, wherein no portion of the second injector channel at least partially blocks an outlet of the second fuel injector, and wherein no portion of the second injector channel causes the second fuel emitted from the second fuel injector to abruptly change direction.

25. The connector device of claim 22, wherein the first fuel injector is elevated relative to the fuel injector opening in the internal combustion engine when the connector device is installed in the fuel injector opening.

26. The connector device of claim 22, wherein the first fuel injector is a gasoline injector and the second fuel injector is a compressed natural gas injector.

27. The connector device of claim 22, wherein the second fuel is an alternative fuel.

28. A method for converting an internal combustion engine to operate using a second fuel, comprising the steps of:

removing a first fuel injector from a fuel injector opening of an internal combustion engine;

installing a connector device in the fuel injector opening, the connector device comprising:

an outlet portion configured to mate with the fuel injector opening and comprising an outlet channel in fluid communication with a combustion chamber of the engine when the connector device is installed in the fuel injector opening, wherein the outlet portion is shaped and configured to provide an interference fit with the fuel injector opening;

a first injector portion comprising a first injector opening in fluid communication with a first injector channel, wherein the first injector opening is configured to receive a discharge portion of the first fuel injector and the first injector channel is in fluid communication with the outlet channel; and a second injector portion comprising a second injector opening in fluid communication with a second injector channel, wherein the second injector opening is configured to receive a discharge portion of a second fuel injector configured to emit a second fuel into the second injector channel, wherein the second fuel is in a gaseous state upon emission from the second fuel injector into the second injector channel, and wherein the second injector channel is in fluid communication with the outlet channel, and wherein the second injector channel is curved to provide a laminar flow of the second fuel through the second injector channel and into the combustion chamber of the engine when the connector device is installed in the fuel injector opening; and installing the first fuel injector in one of the first and second injector openings of the connector device; and installing the second fuel injector in the other of the first and second injector openings of the connector device.

29. The method of claim 28 further comprising repeating the steps of claim 28 for each fuel injector opening of the internal combustion engine.

30. The method of claim 28 further comprising connecting a second fuel source to the second fuel injector.

31. The method claim 28, wherein the first fuel injector is elevated relative to the fuel injector opening in the internal combustion engine when the first fuel injector is installed in the first injector opening of the connector device.

32. The method of claim 28, wherein the first fuel injector is a gasoline injector and the second fuel injector is a compressed natural gas injector, and wherein the first fuel injector is installed in the first injector opening and the second fuel injector is installed in the second injector opening.

33. The method of claim 28, wherein the second fuel is an alternative fuel.

* * * * *